US008655000B1

(12) United States Patent
Solum et al.

(10) Patent No.: US 8,655,000 B1
(45) Date of Patent: Feb. 18, 2014

(54) METHOD AND APPARATUS FOR A FINGER SENSOR FOR A HEARING ASSISTANCE DEVICE

(75) Inventors: Jeffrey Paul Solum, Deephaven, MN (US); Beau Jay Polinske, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 223 days.

(21) Appl. No.: 12/916,909

(22) Filed: Nov. 1, 2010

Related U.S. Application Data

(63) Continuation of application No. 12/813,202, filed on Jun. 10, 2010.

(60) Provisional application No. 61/186,751, filed on Jun. 12, 2009.

(51) Int. Cl.
*H04R 25/00* (2006.01)

(52) U.S. Cl.
USPC ..... 381/315; 381/331

(58) Field of Classification Search
USPC ..... 381/315, 314, 312, 322, 324, 328, 331, 381/330, 380; 371/430; 379/430
See application file for complete search history.

(56) References Cited

U.S. PATENT DOCUMENTS

| | | | | |
|---|---|---|---|---|
| 4,539,440 | A | 9/1985 | Sciarra | |
| 4,679,240 | A * | 7/1987 | Heide | 381/321 |
| 5,341,433 | A * | 8/1994 | Meyer et al. | 381/324 |
| 5,553,152 | A * | 9/1996 | Newton | 381/328 |
| 5,659,621 | A * | 8/1997 | Newton | 381/312 |
| 6,330,339 | B1 * | 12/2001 | Ishige et al. | 381/312 |
| 6,657,595 | B1 | 12/2003 | Phillips et al. | |
| 6,748,089 | B1 | 6/2004 | Harris et al. | |
| 6,920,229 | B2 * | 7/2005 | Boesen | 381/380 |
| 7,142,681 | B2 | 11/2006 | Kortekaas | |
| 7,536,020 | B2 | 5/2009 | Fukumoto et al. | |
| 7,561,708 | B2 * | 7/2009 | Rohrlein | 381/315 |
| 7,831,055 | B2 * | 11/2010 | Frerking et al. | 381/312 |
| 8,055,001 | B2 * | 11/2011 | Boguslavskij | 381/315 |
| 2004/0052391 | A1 * | 3/2004 | Bren et al. | 381/331 |

OTHER PUBLICATIONS

U.S. Appl. No. 12/813,202, Final Office Action mailed Mar. 26, 2013, 6 pgs.
U.S. Appl. No. 12/813,202, Non Final Office Action mailed Jun. 20, 2013, 12 pgs.
U.S. Appl. No. 12/813,202, Non Final Office Action mailed Sep. 17, 2012, 11 pgs.
U.S. Appl. No. 12/813,202, Response filed Jan. 16, 2013 to Non Final Office Action mailed Sep. 17, 2013, 7 pgs.
U.S. Appl. No. 12/813,202, Response filed May 28, 2013 to Final Office Action mailed Mar. 26, 2013, 7 pgs.

* cited by examiner

*Primary Examiner* — Mohammad Islam
*Assistant Examiner* — Phylesha Dabney
(74) *Attorney, Agent, or Firm* — Schwegman Lundberg & Woessner, P.A.

(57) ABSTRACT

A hearing assistance device including a conductive member used for a touch or touch-less sensor for changing a setting, mode, or function of the hearing assistance device. In various applications, the conductive member is also used as an antenna for a wireless communication system.

27 Claims, 4 Drawing Sheets

METHOD AND APPARATUS FOR A FINGER SENSOR FOR A HEARING ASSISTANCE DEVICE

RELATED APPLICATIONS

The present application is a continuation of U.S. patent application Ser. No. 12/813,202, filed on Jun. 10, 2010, which claims the benefit under 35 U.S.C. 119(e) of U.S. Provisional Patent Application Ser. No. 61/186,751, filed Jun. 12, 2009, which applications are incorporated herein by reference.

FIELD OF TECHNOLOGY

This document relates to hearing assistance devices and more particularly method and apparatus for a finger sensor.

BACKGROUND

Hearing assistance devices, such as hearing aids, may be equipped with switches to adjust modes of operation or adjust the volume. Further, hearing aids may be equipped with radios capable of sending and receiving audio and digital information. Wireless communication in the RF spectrum requires antennas capable of receiving signals. Mechanical switches can become unreliable after many uses and are a source of failing within the hearing instrument. Further mechanical switches provide a potential point of ingress for dirt and moisture making them still more prone to failure. By eliminating the mechanical switch used in a hearing instrument, the entire instrument becomes more reliable and lowers the cost to manufacture it.

Recent advancements in switches on hearing aids include "touch-less" or human finger proximity sensors. These sensors may be physically large and may take up a significant amount of room within a small device such as a hearing instrument. One such switch involves measuring a changing capacitance in the presence of the human finger; however, the conductors for such a sensor may be relatively large.

There is a need in the art for improved finger sensors for hearing assistance devices.

SUMMARY

This document provides methods and apparatus for a finger sensor. In various embodiments, a conductive member is used for the finger sensor and for an antenna. In various embodiments, the use of the conductive member is time-division multiplexed between the radio and finger sensor applications. In various embodiments, the conductive sensor is frequency-division multiplexed.

In various embodiments the radio in conjunction with the conductive member is used to detect the presence of a human finger. Various touch sensor and touch-less sensor applications are provided herein.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Recent advancements in ultra-low power communication systems have allowed the inclusion of wireless communications to and from a hearing instrument. This communication involves a low power radio and an antenna. In order to be effective, the antenna is made as large as possible but must still fit within the confines of a small hearing instrument. What is described is a conductive structure that serves as a contact for a touch or touch-less sensor and an antenna for a radio. Various embodiments, including, but not limited to embodiments employing time-division multiplexing or frequency-division multiplexing can be used to avoid harmful interference to the antenna or false detection for the touch sensor. In various embodiments, the radio itself is a sensor for the human finger when it is in close proximity of the hearing instrument.

Figure 1:
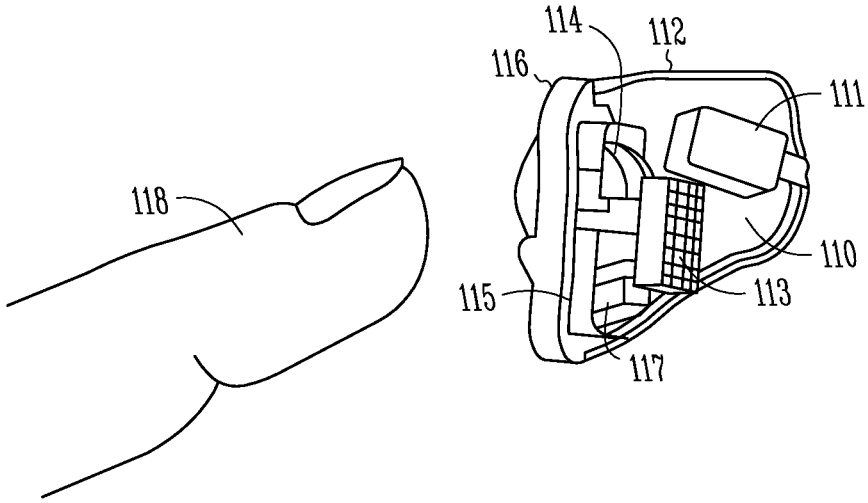
FIG. 1 illustrates an in-the-ear (ITE) or custom hearing assistance device according to one embodiment of the present subject matter.

FIG. 1 illustrates a custom hearing device 110 according to one embodiment of the present subject matter. The illustrated hearing assistance device 110 includes, but is not limited to, a receiver 111, an air vent 112, an electronic circuit including a radio ASIC 113, a battery 114, a conductive member 115 that can serve as an antenna or as a sensor contact, a face plate 116, and a microphone 117. In the illustrated embodiment, the conductive member 115 serves as an antenna for electromagnetic waves as well as a sensor contact for sensing the presence of a human finger 118. In various embodiments, one or more conductors are used as conductive member 115 for electronic wireless communications. When driven by the transmitter part of the circuit of 113, the conductive member 115 converts electrical signals into electromagnetic energy and radiates electromagnetic waves for reception by other devices. In various embodiments, the conductive member 115 is implemented in different configurations. In one embodiment, conductive member 115 is a monopole antenna. In one embodiment, conductive member 115 is a dipole antenna. In one embodiment, conductive member 115 is a patch antenna. In one embodiment, conductive member 115 is a flex antenna. In one embodiment, conductive member 115 is a flexible loop antenna. Other antenna configurations are possible without departing from the scope of the present subject matter.

In another embodiment, the hearing assistance device contains circuitry for sensing the presence of a human finger for the purpose of changing settings functions or modes of the hearing assistance device. For example, in hearing aid applications, in one embodiment the device can serve as a volume control. In another embodiment, the presence of the human finger is detected using a radio in the hearing assistance device. For example, in applications where a radio application specific integrated circuit (ASIC) is used, the radio ASIC in conjunction with the conductive member will act as a sensor. The radio will adjust its tuning as a finger is brought within proximity of the high Q antenna, and such adjustments can be monitored to signal that the finger is in proximity. In various embodiments the conductive member 115 is used as an antenna for the RF subsystem and is multiplexed for use as a capacitive transducer for touch sensing electronics within the circuit of 113.

It is understood that in various embodiments, the proximity of a finger or its actual touch to the hearing assistance device can be sensed by adjustment of the electronics. Thus, in embodiments, where only finger proximity is sensed, but actual touch is not required for sensing, the sensor is a "touchless" sensor. It is understood that a variety of finger motions and/or finger touches can be employed to make function, mode, or setting adjustments without departing from the scope of the present subject matter.

In various embodiments, the radio is duty cycled to conserve power and wakes up at regular intervals to check for possible incoming RF transmissions at which time it will tune to an appropriate channel to receive information. While tuning the radio, tuning parameters can be interrogated by a microcontroller or DSP to determine if a significant change in the tuning has occurred which may indicate the presence of a human finger. If that is the case the processor or microcontroller or DSP on 113 can take appropriate action such as changing modes selected by the user. The user is then informed of this change via audible signals such as a tone, set of tones, or a stored or synthesized voice signal indicating the change of mode.

In various embodiments, a baseline set of tuning parameters is maintained to determine the quiescent "no finger present" state so that once a finger is brought nearby the antenna or sensor it is readily sensed without false detection.

Figure 2:
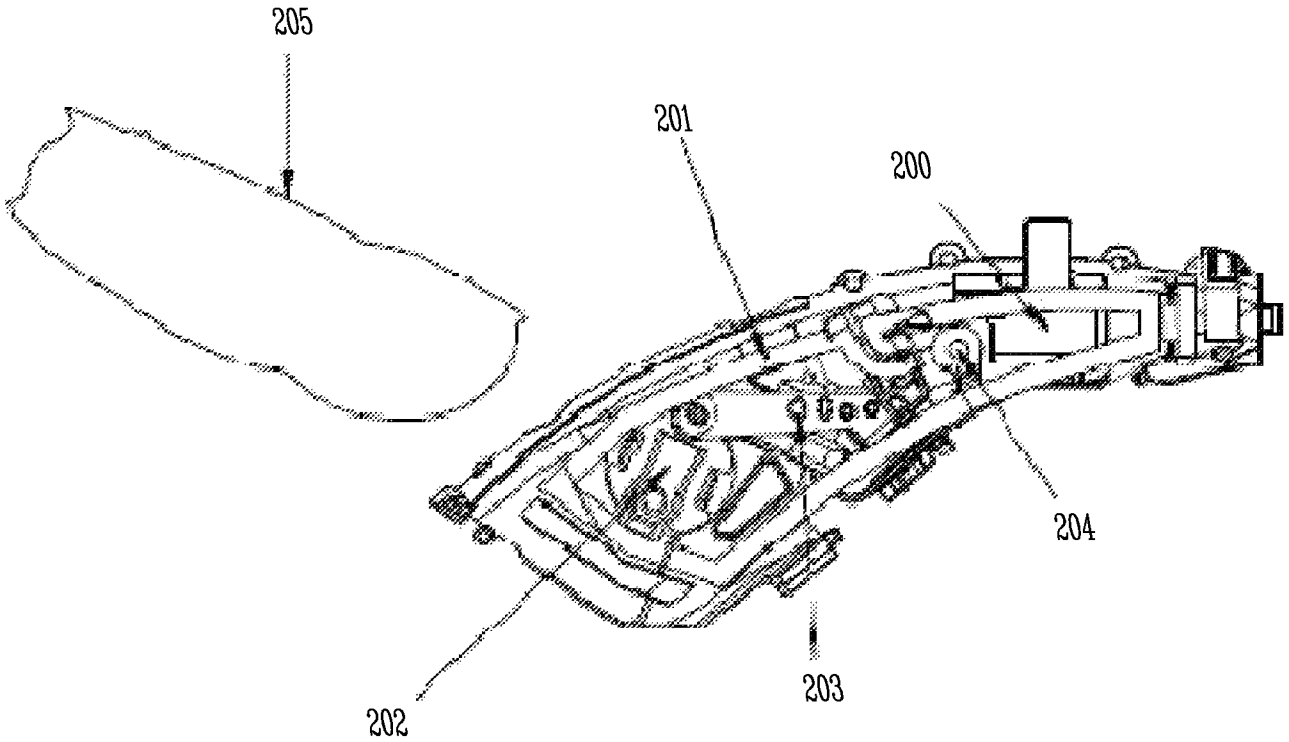
FIG. 2 illustrates a standard-fit behind-the-ear hearing assistance device having the receiver mounted in the wearer's ear canal (receiver-in-canal or RIC), according to one embodiment of the present subject matter.

FIG. 2 illustrates a standard-fit type hearing device according to one embodiment of the present subject matter. The illustrated hearing assistance device of FIG. 2 includes a microphone 200, an electronic circuit including a radio ASIC 203 a battery 202, a conductive member 201 and an inductive signal sensor 204. In various embodiments the conductive member 201 acts as a sensor contact, an antenna, or both. In various embodiments, the inductive signal sensor 204 includes, but is not limited to, a telecoil or a magnetorestrictive sensor, such as a giant magnetoresistance sensor (gmr sensor), an anisotropic magnetoresistance sensor (amr sensor), a tunneling magnetoresistance sensor (TMR sensor). In the illustrated embodiment, the conductive member 201 serves as an antenna for electromagnetic waves as well as a sensor contact for sensing the presence of a human finger 205. In various embodiments, one or more conductors are used as an antenna for electronic wireless communications. When driven by the transmitter part of the circuit of 203, the conductive member 201 converts electrical signals into electromagnetic energy and radiates electromagnetic waves for reception by other devices. In various embodiments, the conductive member 201 is implemented in different configurations. In one embodiment, conductive member 201 is a monopole antenna. In one embodiment, conductive member 201 is a dipole antenna. In one embodiment, conductive member 201 is a patch antenna. In one embodiment, conductive member 201 is a flex antenna. In one embodiment, conductive member 201 is a flexible loop antenna. Other antenna configurations are possible without departing from the scope of the present subject matter.

In another embodiment, the hearing assistance device contains circuitry for sensing the presence of a human finger for the purpose of changing settings functions or modes of the hearing assistance device. For example, in hearing aid applications, in one embodiment the device can serve as a volume control. In another embodiment, the presence of the human finger is detected using a radio in the hearing assistance device. For example, in applications where a radio application specific integrated circuit (ASIC) is used, the radio ASIC in conjunction with the conductive member will act as a sensor. The radio will adjust its tuning as a finger is brought within proximity of the high Q antenna, and such adjustments can be monitored to signal that the finger is in proximity. In various embodiments the conductive member 201 is used as an antenna for the RF subsystem and is multiplexed for use as a capacitive transducer for touch sensing electronics within the circuit of 203.

It is understood that in various embodiments, the proximity of a finger or its actual touch to the hearing assistance device can be sensed by adjustment of the electronics. Thus, in embodiments, where only finger proximity is sensed, but actual touch is not required for sensing, the sensor is a "touchless" sensor. It is understood that a variety of finger motions and/or finger touches can be employed to make function, mode, or setting adjustments without departing from the scope of the present subject matter.

In various embodiments, the radio is duty cycled to conserve power and wakes up at regular intervals to check for possible incoming RF transmissions at which time it will tune to an appropriate channel to receive information. While tuning the radio, tuning parameters can be interrogated by a microcontroller or DSP to determine if a significant change in the tuning has occurred which may indicate the presence of a human finger. If that is the case the processor or microcontroller or DSP on 203 can take appropriate action such as changing modes selected by the user. The user is then informed of this change via audible signals such as a tone, set of tones, or a stored or synthesized voice signal indicating the change of mode.

In various embodiments, a baseline set of tuning parameters is maintained to determine the quiescent "no finger present" state so that once a finger is brought nearby the antenna or sensor it is readily sensed without false detection.

In applications employing the radio, various calibration techniques are used to tune the antenna and voltage controlled oscillator on the radio. Some of these tuning and calibration procedures are done for the purpose of adapting certain circuits on the radio for the frequency of operation. Other adaptations are done to tune out parasitic capacitance and variations in antenna conductor placement, bending, and distorting that may occur in the manufacturing process, still others are done to compensate for the proximity of the antenna to the human head, specifically the human ear on which the hearing instrument is placed. The system employed involves a high Q circuit that is very susceptible to variations in parasitic capacitance that may include the antenna being near the human body or a human finger coming into near proximity. It is possible then to use the tuned values from the radio to determine if a human finger is in near proximity of the antenna. In ear to ear communication the radio is periodically awakened on a predetermined schedule to see if any information is being sent from another source such as another hearing aid or accessory in close proximity. Circuitry within the radio must tune the radio prior to being able to successfully receive a packet. The radio can monitor the calibration values to determine a baseline setting "no finger present" for various tuning parameters such as antenna trim or VCO trim. In the presence of a human finger within proximity of the antenna these tuning parameters will change significantly. An algorithm for monitoring these values and comparing them to baseline values can be used to initiate an action such as changing settings within the hearing instrument such as memory mode, microphone directionality, volume control, etc. based on a patient's finger being in proximity of the RF antenna. Further, circuitry within the radio transceiver can trigger an interrupt whenever the parameters move significantly from a baseline, thus indicating the presence of a human finger.

In various embodiments, the touch sensor or touch-less sensor is used to replace one or more controls of a hearing assistance device, such as a hearing aid. In various embodiments, the touch switch or touch-less switch provides another control to the hearing assistance device.

Figure 3:
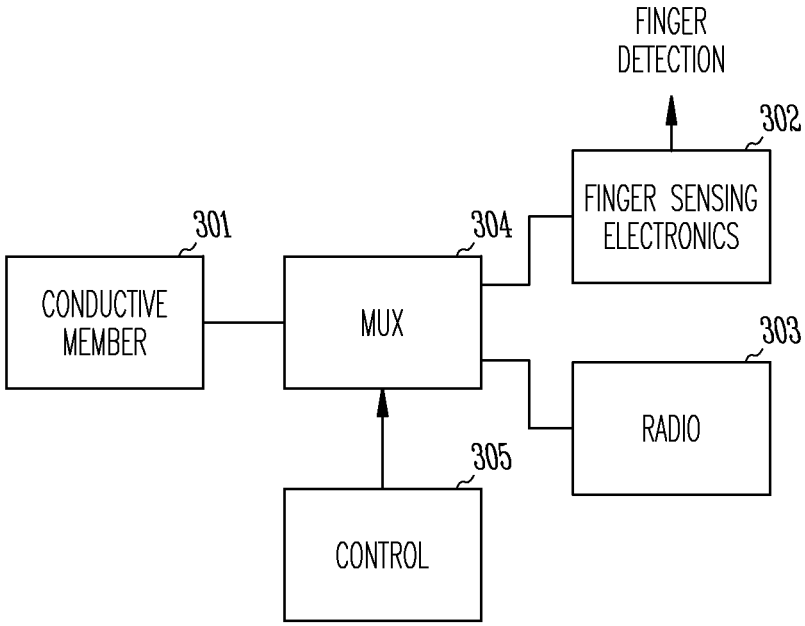
FIG. 3 is a block diagram showing a multiplexed sensing and radio application, according to one embodiment of the present subject matter.

FIG. 3 is a block diagram showing a multiplexed sensing and radio application, according to one embodiment of the present subject matter. Conductive member 301 is connected to a multiplexing element 304 which controls the connection to radio 303 and finger sensing electronics 302. In various embodiments, the control 305 can be a time base for time-division multiplexing. In such embodiments, control 305 is used to select whether the radio 303 or the finger sensing electronics 302 is connected to the conductive member 301. In various embodiments, multiplexing element 304 is frequency-division multiplexing, which allows communications between both radio 303 and finger sensing electronics 302, but in different frequency regions. Other connections are possible without departing from the scope of the present subject matter.

Figure 4:
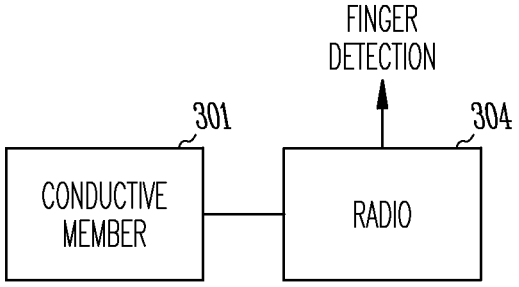
FIG. 4 is a block diagram showing an application where the radio provides sensing, according to one embodiment of the present subject matter.

FIG. 4 is a block diagram showing an application where the radio provides finger sensing, according to one embodiment of the present subject matter. Conductive member 401 is in contact with the radio 402, which is programmed to provide the finger detection function. In such embodiments, the radio is programmed as described herein to provide the detection of a finger in proximity to the conductive member 401 for a touch-less sensor, or touch, in the case of a touch sensor.

The present subject matter includes applications to hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. It is understood that other hearing assistance devices not expressly stated herein may fall within the scope of the present subject matter.

This application is intended to cover some adaptations or variations of the present subject matter. It is to be understood that the above description is intended to be illustrative, and not restrictive. The scope of the present subject matter should be determined with reference to the appended claims, along with the full scope of equivalents to which such claims are entitled.

What is claimed is:

1. A hearing assistance device, comprising:
hearing assistance electronics;
finger sensing electronics;
radio electronics; and
an antenna in communication with the radio electronics for receiving radio signals and in communication with the finger sensing electronics, wherein the finger sensing electronics is configured to sense finger proximity or finger touch using the antenna.

2. The hearing assistance device of claim 1, wherein the antenna is a monopole antenna.

3. The hearing assistance device of claim 1, wherein the antenna is a dipole antenna.

4. The hearing assistance device of claim 1, wherein the antenna is a patch antenna.

5. The hearing assistance device of claim 1, wherein the antenna is a flex antenna.

6. The hearing assistance device of claim 1, wherein the antenna is a flexible loop antenna.

7. The hearing assistance device of claim 1, further comprising a multiplexer connecting the antenna to the radio electronics and the finger sensing electronics.

8. The hearing assistance device of claim 1, wherein the settings, functions, or modes of the hearing assistance electronics are changed based on detections by the finger sensing electronics.

9. The hearing assistance device of claim 1, further comprising a magnetorestrictive sensor.

10. The hearing assistance device of claim 1, further comprising a giant magnetoresistance sensor.

11. The hearing assistance device of claim 1, further comprising an anisotropic magnetoresistance sensor.

12. The hearing assistance device of claim 1, further comprising a tunneling magnetoresistance sensor.

13. A hearing assistance device, comprising:
hearing assistance electronics;
radio electronics; and
a conductive member in communication with the radio electronics,
wherein the radio electronics is configured to provide the hearing assistance device with a radio for communications using the conductive member as an antenna and to detect finger proximity using the conductive member by monitoring adjustment of tuning of the radio resulting from presence of a finger within proximity of the conductive member.

14. The hearing assistance device of claim 13, wherein the conductive member is a monopole antenna.

15. The hearing assistance device of claim 13, wherein the conductive member is a dipole antenna.

16. The hearing assistance device of claim 13, wherein the conductive member is a patch antenna.

17. The hearing assistance device of claim 13, wherein the conductive member is a flex antenna.

18. The hearing assistance device of claim 13, wherein the conductive member is a flexible loop antenna.

19. The hearing assistance device of claim 13, wherein the settings, functions, or modes of the hearing assistance electronics are changed based on detections by the finger sensing electronics.

20. The hearing assistance device of claim 19, wherein the finger sensing electronics is configured to sense finger motions or finger touches.

21. The hearing assistance device of claim 13, further comprising a magnetorestrictive sensor.

22. The hearing assistance device of claim 13, further comprising a giant magnetoresistance sensor.

23. The hearing assistance device of claim 13, further comprising an anisotropic magnetoresistance sensor.

24. The hearing assistance device of claim 13, further comprising a tunneling magnetoresistance sensor.

25. A hearing assistance device, comprising:

hearing assistance electronics configured to be adjusted in response to detection of finger proximity or finger touch; radio electronics configured to provide the hearing assistance device with radio communications; finger sensing electronics configured to detect the finger proximity or finger touch; an antenna in communication with the radio electronics; and a multiplexer connecting the antenna to the radio electronics and the finger sensing electronics.

26. The hearing assistance device of claim 25, wherein the multiplexer is configured for time-division multiplexing.

27. The hearing assistance device of claim 25, wherein the multiplexer is configured for frequency-division multiplexing.

* * * * *